US008327862B2

(12) United States Patent
Haltmayer et al.

(10) Patent No.: US 8,327,862 B2
(45) Date of Patent: Dec. 11, 2012

(54) DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Martin Weissenburger, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 335 days.

(21) Appl. No.: 12/641,510

(22) Filed: Dec. 18, 2009

(65) Prior Publication Data

US 2010/0154847 A1 Jun. 24, 2010

(30) Foreign Application Priority Data

Dec. 19, 2008 (DE) ..... 10 2008 055 017

(51) Int. Cl.
*B08B 3/02* (2006.01)

(52) U.S. Cl. ..... 134/201; 68/3 R; 29/428

(58) Field of Classification Search ..... 68/3 R; 134/200; 312/228
See application file for complete search history.

(56) References Cited

U.S. PATENT DOCUMENTS 3,834,783 A * 9/1974 Jenkins ..... 312/351.3
4,295,692 A * 10/1981 Jenkins ..... 312/228
6,236,570 B1 5/2001 Gotzfried et al.
8,178,802 B2 * 5/2012 Roose et al. ..... 200/296
2004/0154347 A1 * 8/2004 No et al. ..... 68/12.01
2005/0017609 A1 * 1/2005 Kucuk et al. ..... 312/228
2008/0196751 A1 * 8/2008 Poyner et al. ..... 134/57 D
2009/0165833 A1 7/2009 Rehm et al.

FOREIGN PATENT DOCUMENTS

JP 09-028651 * 2/1997
JP 2001-198070 * 7/2001
JP 2006-204497 * 8/2006
KR 2002023559 * 3/2002
KR 2004011974 * 2/2004
KR 793763 * 2/2008

OTHER PUBLICATIONS

European Patent Office 0 238 115 02-1098.*
European Patent Office 0 805 617 Nov. 1997.*
European Patent Office 1 994 856 Nov. 2008.*
Eupopean Patent Office 1 635 935 Mar. 2006.*

* cited by examiner

*Primary Examiner* — Frankie L Stinson

(74) *Attorney, Agent, or Firm* — James E. Howard; Andre Pallapies

(57) ABSTRACT

A dishwasher comprising a wash compartment with a base wall that has a retaining contour, and an electronic control module supported by the retaining contour and which controls appliance components in the dishwasher.

17 Claims, 6 Drawing Sheets

DISHWASHER

BACKGROUND OF THE INVENTION

A plurality of appliance components in the dishwasher, for instance a drain pump or a circulating pump, are usually provided in an assembly space provided below the wash compartment of a dishwasher, the appliance components being controlled during a wash cycle by means of an electronic control module.

A generic dishwasher includes a wash compartment and such an electronic control module. During installation of the dishwasher, the electronic control module is usually inserted into a receiving pocket available in the assembly base of the dishwasher. The wash compartment is then placed on the assembling base.

BRIEF SUMMARY OF THE INVENTION

In the case of an installed dishwasher, the electronic control module is thus accessible from the outside only with difficulty. This is particularly disadvantageous in the case of a subsequent disassembly of the electronic control module. Furthermore, the handling of the dishwasher in the case of the electronic control module being programmed on the assembly line at the factory is also complicated. With such a programming, the electronic control module incorporated into the dishwasher is connected to a programming device An object of the invention is to provide a dishwasher as well as a method for assembling such a dishwasher, in which a positionally-correct and easily externally accessible positioning in terms of assembly takes place easily.

An exemplary embodiment of the invention is based on a dishwasher with a wash compartment and an electronic control module, which controls the appliance components arranged in the dishwasher. A base wall of the wash compartment has a retaining contour, on which the electronic control module is supported. Contrary to the prior art, the retaining contour is thus not provided on the assembly base of the dishwasher, but is instead arranged at a distance therefrom on a wash compartment wall. The electronic control module can thus be assembled and/or disassembled favorably in terms of assembly space and independently of the assembly base of the dishwasher.

It is simple from a manufacturing point of view, if the retaining contour is integrated in the same material and/or as a single piece on the wash compartment, in particular in its base wall. The base wall with the integrated retaining contour can be produced simply from a manufacturing point of view using plastic injection molding. The base wall is thus an economical plastic part, on which the remaining wash compartment walls made of stainless steel sheet can be positioned. With such an assembly, the still separate wash compartment base wall can be connected to the electronic control module in a first assembly step. The remaining wash compartment walls can then be placed on the base wall.

The electronic control module preferably protrudes into the assembly space located below the wash compartment, in which a large number of other appliance components, for instance circulating pump or drain pump, is usually provided. As a result, the installation length of the electrical lines passing therebetween can be reduced. The retaining contour can therefore preferably protrude downwards into the assembly space.

The assembly position of the electronic control module can advantageously be distanced from the base of the dishwasher by a free height. The retaining contour with the electronic control module mounted thereupon is thus arranged at an easily accessible height above the dishwasher base.

In a preferred embodiment, the wash compartment base wall can be supported on the base at its corner regions by way of front and rear support profiles. Lateral front and rear support profiles are preferably integrated in a supporting frame respectively, said supporting frame bounding a frame opening, in which the electronic control module can be arranged at least partially in an easily accessible position.

Here the retaining contour can be provided at least partially on the support profiles or the supporting frame. The retaining contour can preferably comprise at least one supporting section, which supports the electronic control module in its assembly position. With respect to a simple accessibility of the retaining contour, the supporting section can preferably be a boundary wall on the base-side periphery of the aforecited frame opening. The supporting section is preferably designed so as to be elastic in order to absorb impact loads, during transportation or during the assembly of the dishwasher, onto the electronic control module.

The retaining contour can also comprise positioning stops, which simplify a positionally-correct locating of the electronic control module. The positionally-correct locating of the electronic module is important particularly when programming the electronic control module at the factory. With such a programming, the electronic control module of the dishwasher located on the assembly line is connected to a programming device. To ensure automatic contacting, the positionally-correct locating of the electronic control module is advantageous in terms of process.

Against this background, the retaining contour can include positioning stops, i.e. at least one depth stop and/or a side stop, which determines the electronic control module in depth direction and/or lateral direction. With a view to a positionally-correct locating, the depth and side stops, contrary to the supporting section, are rigid and inherently stable. The positioning stops are thus preferably provided at a distance from the elastic supporting section. The positioning stops on the base wall and/or a rear wall protruding down therefrom are preferably provided as positioning ribs.

The retaining contour can also comprise at least one preferably elastically adjustable locking element. In its locking position, the locking element can hold the electronic control module in its post assembly position. In the event of a subsequent disassembly of the electronic control module, the locking element can be switched into a locking position, as a result of which the electronic control module can preferably be disassembled through the frame opening of the supporting frame.

For a simple actuation of the locking element, this can protrude into the frame opening of the supporting frame. To be able to easily perform a switching movement between the locking and unlocking position, the locking element can be embodied on the elastically configured supporting section, on which the electronic control module is supported.

In a method for assembling the dishwasher, the wash compartment base wall can be turned upside down in a first assembly step. As a result, the lower face thereof is easily accessible for assembly of the electronic control module. In a preassembly step, the electronic control module with a peripheral face is then inserted between the positioning stops of the retaining contour. The positioning stops are preferably molded on the base wall lower face as ribs.

The electronic control module prepositioned in this way can then be tilted with its opposite peripheral face into a final assembly position. In the final assembly position, the aforecited locking element can be locked to the electronic control module. The locking element can, by way of example, be locking strips engaging in the frame opening, said locking strips being elastically flexible out of their position of rest. When tilting the electronic control module into its final assembly position, the at least one locking element can be manually brought into its unlocking position. As a result, the tilting movement of the electronic control module is released into the final assembly position. The locking element can then spring back into an undercut or a counter locking element of the electronic control module.

As a result of the elasticity of in particular the supporting section and/or the locking element, a simple, tool-free and also operationally-reliable centering and locking of the electronic control module is enabled with minimal assembly effort. The existing elasticity of the retaining contour and the positioning in the side region of the washing tub very easily allows for the possible subsequent disassembly of the module housing from the fully assembled dishwasher.

BRIEF DESCRIPTION OF THE DRAWINGS

An exemplary embodiment of the invention is described below with reference to the appended Figures, in which.

DETAILED DESCRIPTION OF EXEMPLARY EMBODIMENTS OF THE PRESENT INVENTION

Figure 1:
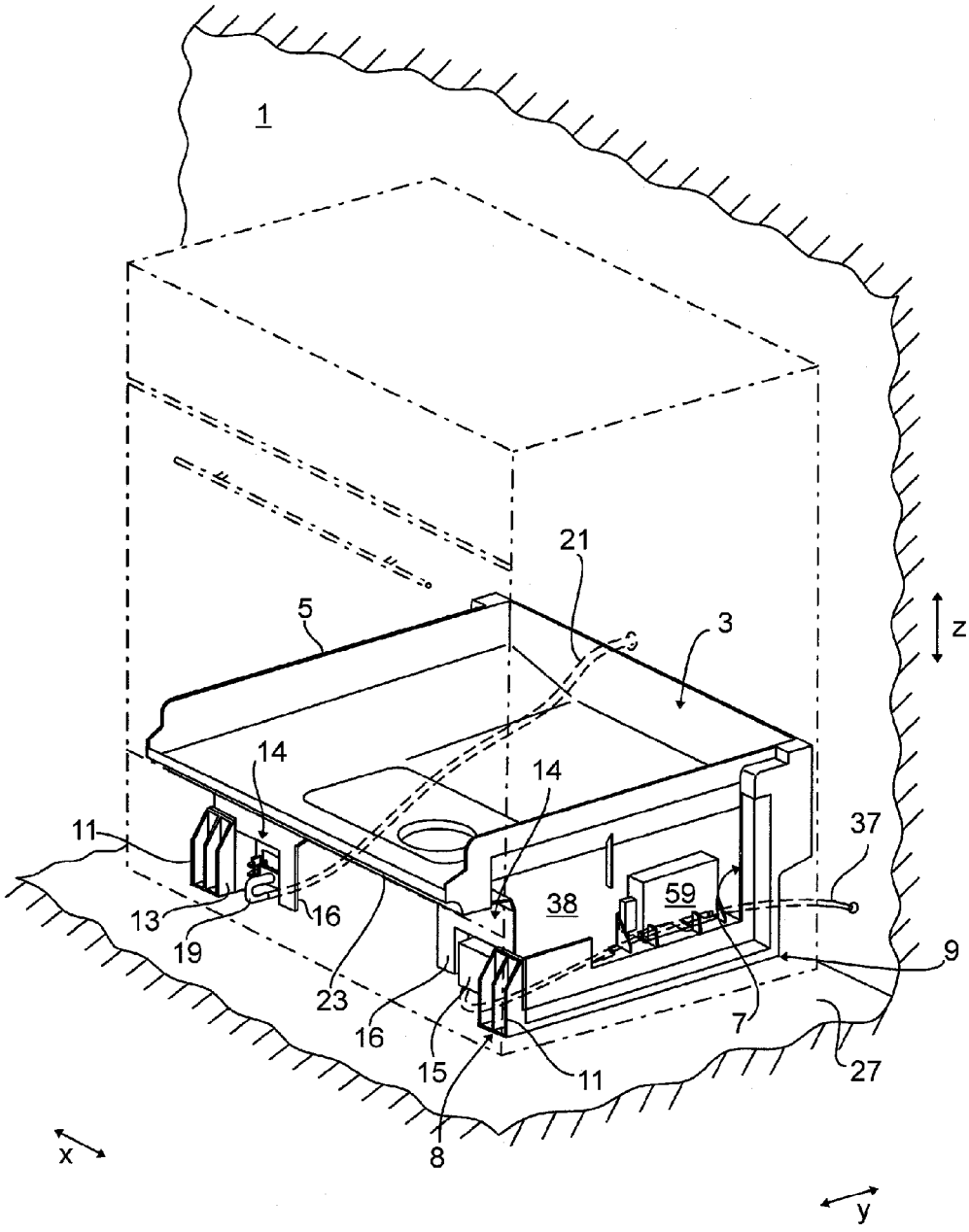
FIG. 1 shows a rough schematic representation of an installed dishwasher.

FIG. 1 shows a rough schematic perspective representation of a dishwasher installed on a side wall 1. The housing walls and the appliance door of the dishwasher are only indicated with a dash-dotted line for reasons of clarity. Also for easier understanding of the invention, a base wall 3 of the wash compartment of the dishwasher only is shown, while a representation of the overall wash compartment and/or the known appliance components, like for instance the sump, circulating pump, drain pump or electronic control components is omitted.

The wash compartment base wall 3 shown in FIG. 1 is manufactured here by way of example as a plastic injected molded part. The base wall 3 is provided with laterally elevated peripheral faces 5, on which rest the side walls (not shown) of the wash compartment, the remainder of which is made of stainless steel sheet. The base wall 3 bounds a wash chamber at the base.

Molded on each of the outer faces of the base wall 3, which are opposite one another in the appliance lateral direction x, is a supporting frame 7, which can support appliance feet (not shown) at its front and/or rear corner regions 8, 9 respectively. The two lateral supporting frames 7 have guide shafts 11 at each of their front support profiles 8, in which the appliance feet are guided with vertical movement. Retaining elements 14 for a power network connection element 15 and for a water inlet valve (not shown in more detail) of the hydraulic circuit of the dishwasher, are configured respectively on the facing side walls 13 of the guide shafts 11. Each of the two retaining elements 14 has an assembly wall 16, which is molded on the assigned guide shaft side wall 13 and to the lower face of the base wall 3. An elbow 19 of a supply hose 21 leading to the water supply network is connected to the left assembly wall 16 shown in FIG. 1 at the water inlet valve 17.

The two assembly walls 16 on the front face bound a central tool access opening 23 to an assembly space 25 below the wash compartment base wall 3. The assembly space 25 is not bounded at its base by a closed assembly base of the dishwasher but is configured as open.

A network cable 37 leading from the power supply network is connected by way of the power network connection housing 15 to electric lines, which are led to a laterally-arranged electronic control module 38.

The electronic control module 38 controls the appliance components in the dishwasher during a wash cycle. Here the electronic control module 38 is incorporated in a side region of the base wall 3 by way of a retaining contour 42 directly on the lateral supporting frame 7, as shown enlarged in FIG. 2. The retaining contour 42 consisting of a number of individual components is shown by itself in FIG. 3. All individual components of the retaining contour 42 are integrated into the base wall using injection molding.

Figure 2:
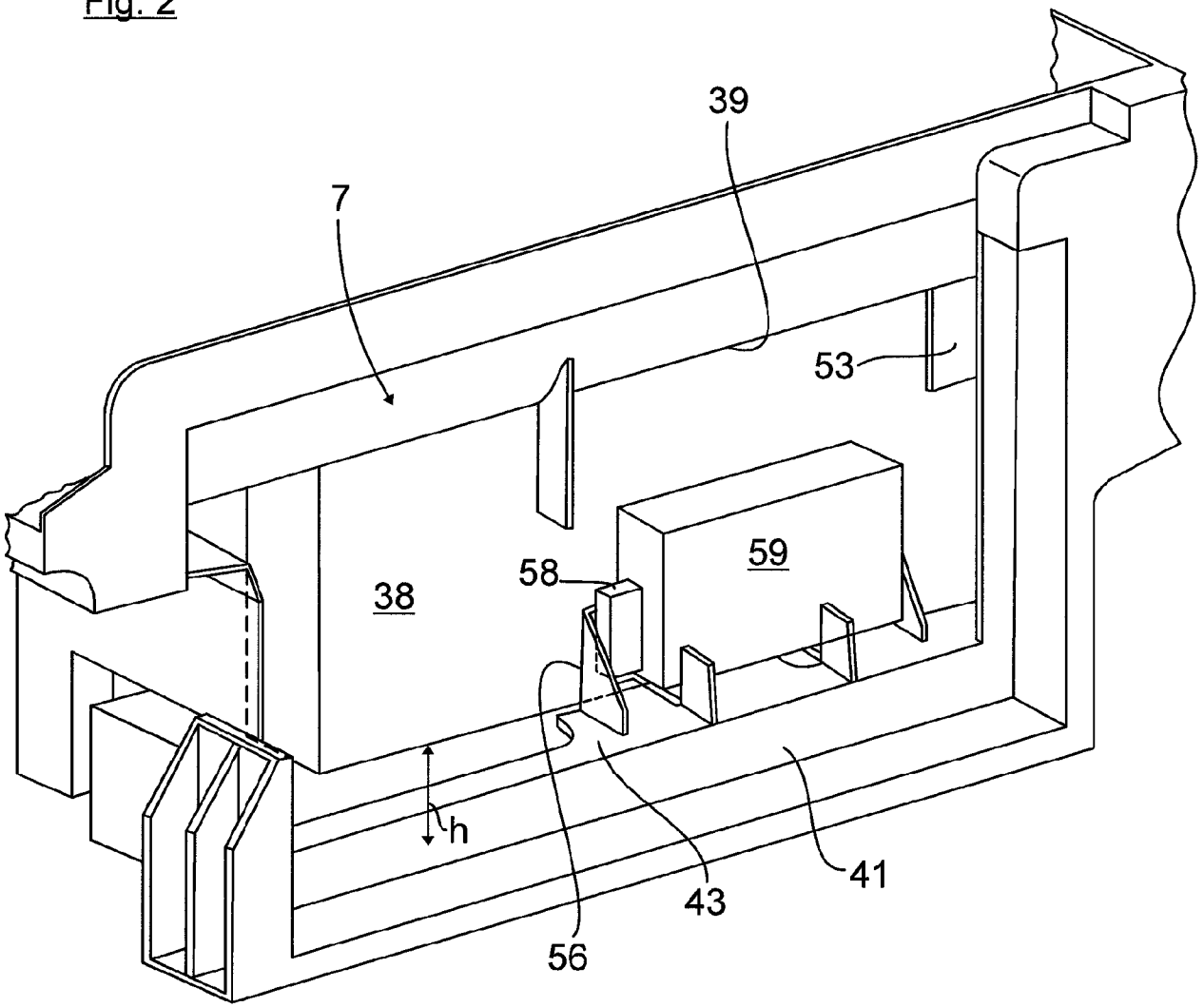
FIG. 2 shows an enlarged detailed view of the detail Z from FIG. 1, in which the electronic control module incorporated in a supporting frame of the wash compartment base wall is shown.

As apparent from FIG. 2, the electronic control module 38 is held almost completely in the frame opening 39 enclosed by the supporting frame 7. To this end the inventive retaining contour 42 comprises a support plate 43 on a plinth 41 of the supporting frame 7, said support plate being molded to the periphery of the frame opening 39 at the base. The electronic control module 38 is thus favorably distanced, in terms of assembly and disassembly, from the standing surface 27 of the dishwasher at a height h. The support plate 43 extends approximately horizontally into the appliance interior and is provided with cutouts 45, as a result of which the support plate 43 is overall elastically resilient. The afore-cited plinth 41 connects the two supporting profiles 8, 9 of the base wall 3.

Figure 3:
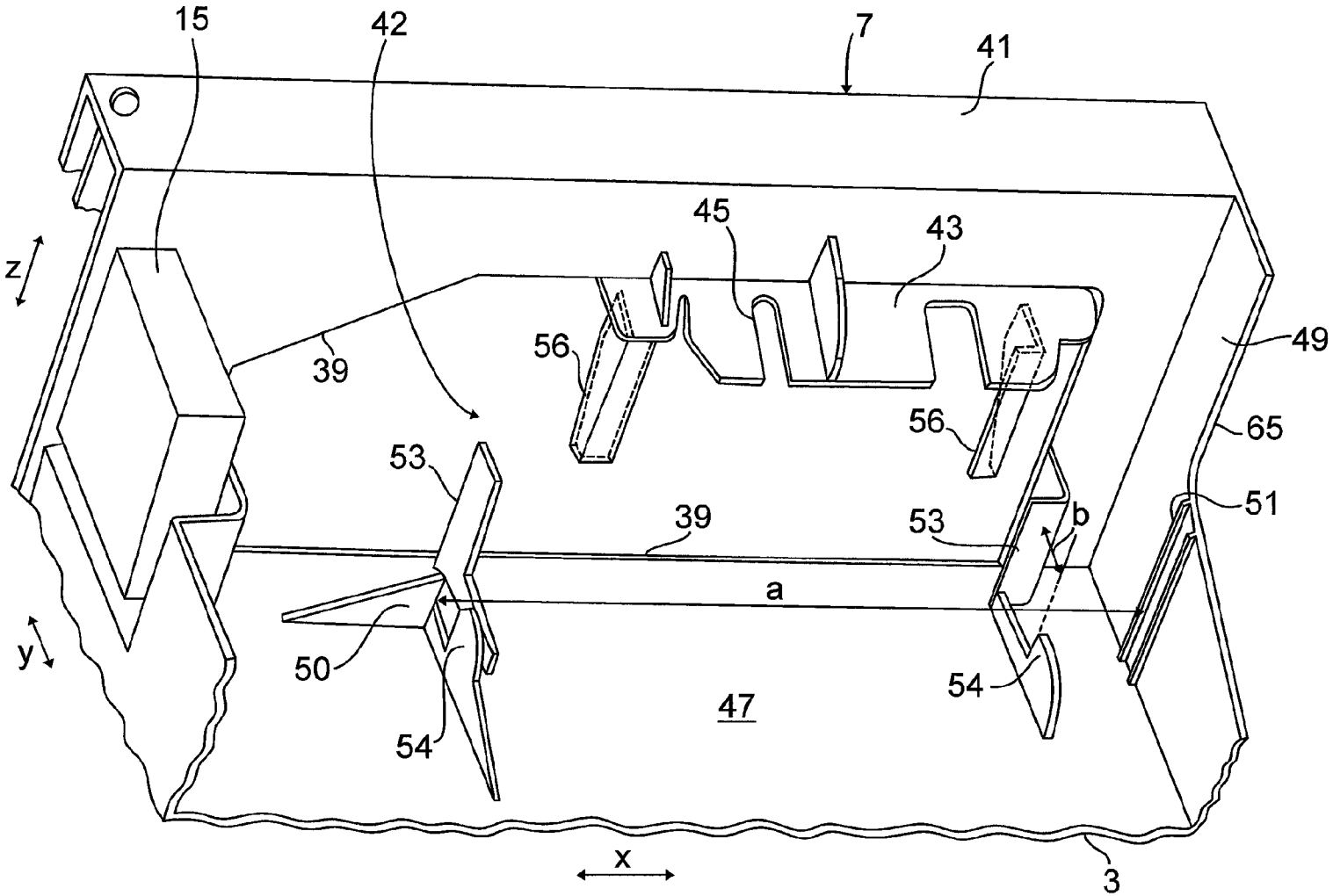
FIG. 3 shows a view of the interior of a lateral supporting frame of the base wall in the case of a disassembled electronic control module.
Figure 4:
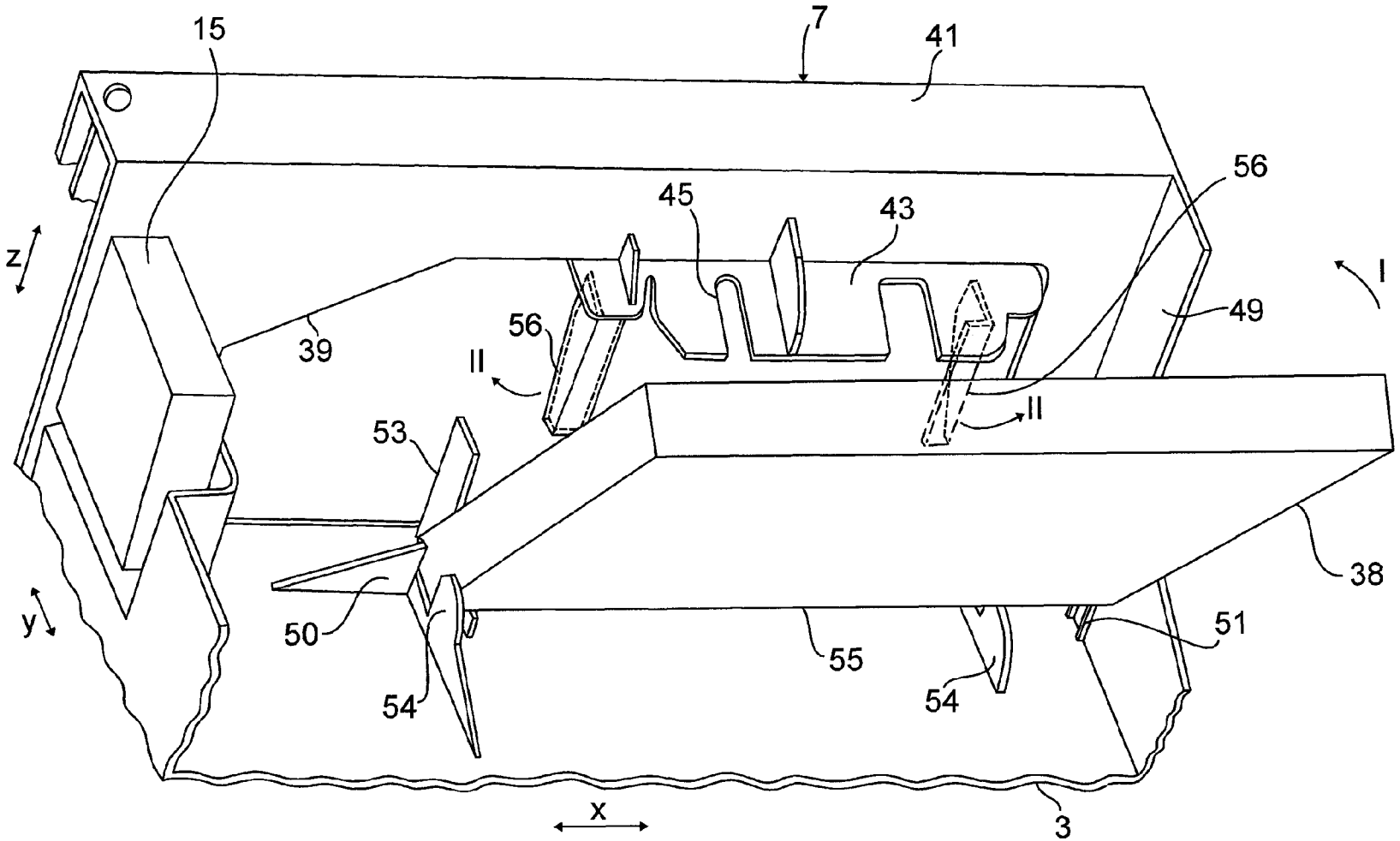
FIG. 4 shows a view according to FIG. 3 of the retaining contour with the electronic control module preassembled between the positioning stops.
Figure 5:
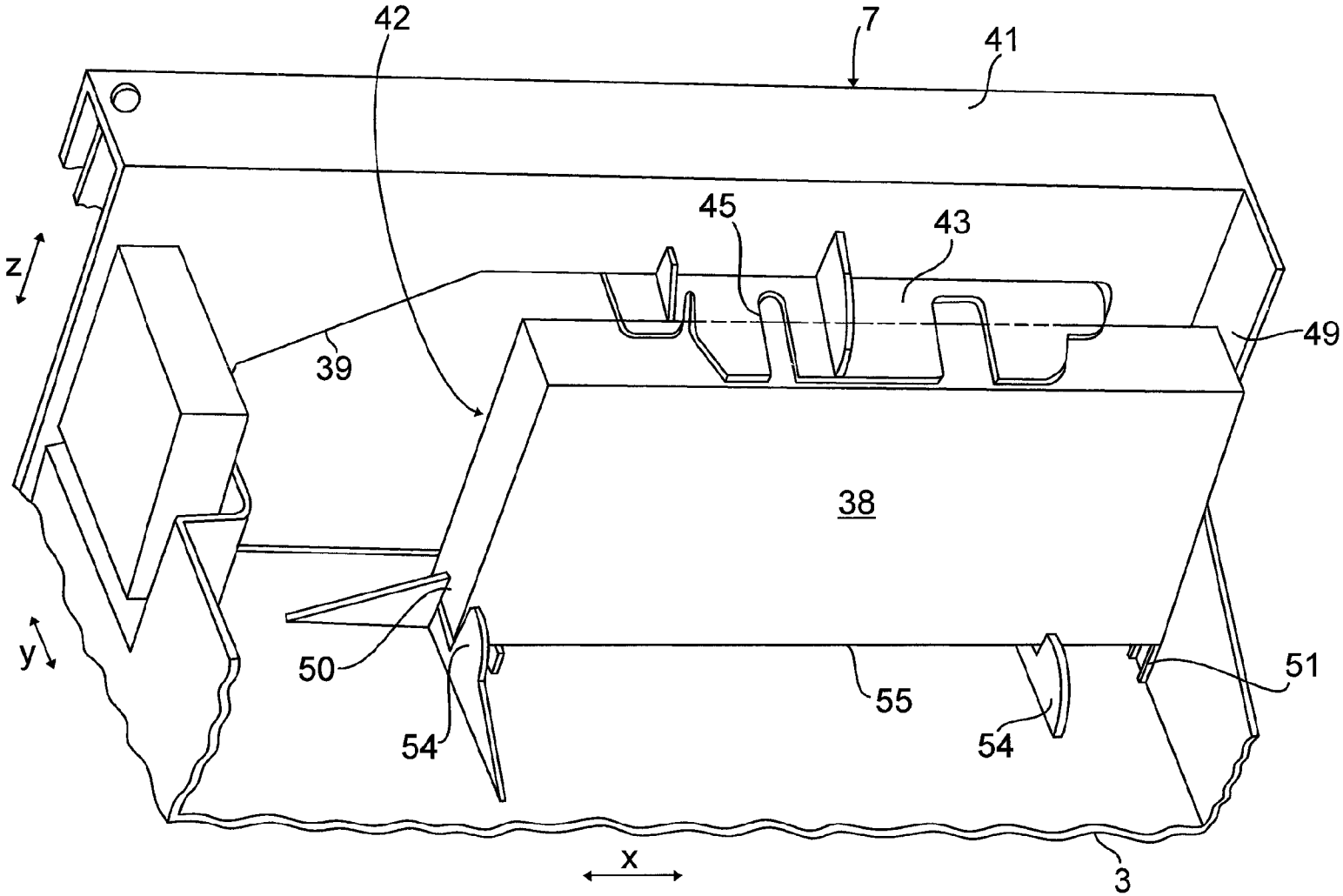
FIG. 5 shows a view according to FIGS. 3 and 4 of the electronic control module in its final assembly position.

The assembly of the electronic control module 38 into the retaining contour 42 of the base wall 3 is explained with the aid of FIGS. 3 to 5. FIGS. 3 to 5 show an enlarged cutaway of the interior of retaining contour 42 provided on the supporting frame 7 when the electronic control module is disassembled. The base wall 3 is shown in FIGS. 3 to 5 in its assembly position, in which the base wall 3 points upwards with its lower face 47, rotated through 180°. The positioning stops of the retaining contour 42 are molded to the lower face 47 of the base wall 3 and to a rear wall 49 of the base wall 3. Opposite depth stops 50, 51 are thus provided in the depth direction y, of which one depth stop is molded to the base lower face 47 as a wedge-shaped rib 50 and the opposite depth stop 51 is embodied on the interior of the rear wall 49 as a vertical double rib.

To fix the electronic control module 38 in the appliance lateral direction x, opposite side stops 53, 54 are molded to the base lower face 47. The two lateral external side stops 53 are embodied here as elevated stop webs, which protrude far into the frame opening 39. The two stop webs 53 bound a tilting movement (indicated with arrow I in FIG. 4) of the preassembled electronic control module 38 in its final assembly position. The side stops 54 facing the stop webs 53 are configured as planar ribs on the base wall lower face 57, said ribs marginally encompassing a peripheral face of the electronic control module 38. The distance a between the depth stops 50, 51 and the distance b between the side stops 53, 54 is dimensioned marginally larger than the length and width of the electronic control module 38 to be inserted therein. The electronic control module 38 is thus centered with its upper peripheral edge 55 on the base wall 3 with little play and voltage-free.

The support plate 43 molded on the plinth 41 of the supporting frame 7 covers the positioning stops 50 to 54 on the side of the base wall at least partially and determines the height h of the electronic control module 38 in the height axis direction z.

Elevated locking webs 56, which are distanced from one another and engage in the frame opening 39, are molded on the side of the support plate 43 facing the positioning stops 50 to 54. The two locking webs 56 are configured to be angular in terms of profile and have two locking limbs 57 which face one another. In the final assembly position according to FIG. 2, the two locking limbs 57 engage behind a corresponding undercut 58 of the electronic control module 38. Housing recesses which already exist on the exterior faces of the electronic control module 38 can be used as undercuts 58.

As apparent from FIG. 4, in a preassembly step, the electronic control module 38 is inserted at an angle and head first with its upper peripheral face between the positioning stops 50 to 54 on the base wall side. In a final assembly step, the electronic control module 38 is then brought into its final assembly position using a tilting movement I, as shown in FIG. 5.

When tilting the electronic control module 38 into its final installation position, the locking webs 56 are locked to the undercuts 58 on the module side. To this end, the locking webs 56 are manually bent apart in an actuation direction II in accordance with FIG. 4, until the electronic control module 38 with its housing projection 59 can be guided past both locking webs 56.

The two locking webs 56 are elastically bent apart from one another in the actuation direction II counter to a reset force. The elasticity required herefor results on the one hand from the installation height of the locking web 56 and on the other hand from the rigidity of the support plate 43 which is reduced by means of the cutouts 45.

After the final assembly of the electronic control module 38 and the other appliance components (not shown here) on the lower face 47 of the washing compartment base wall 3, electrical lines are routed between the individual appliance components and the assembled base wall 3 is then moved back into its post assembly position.

Figure 6:
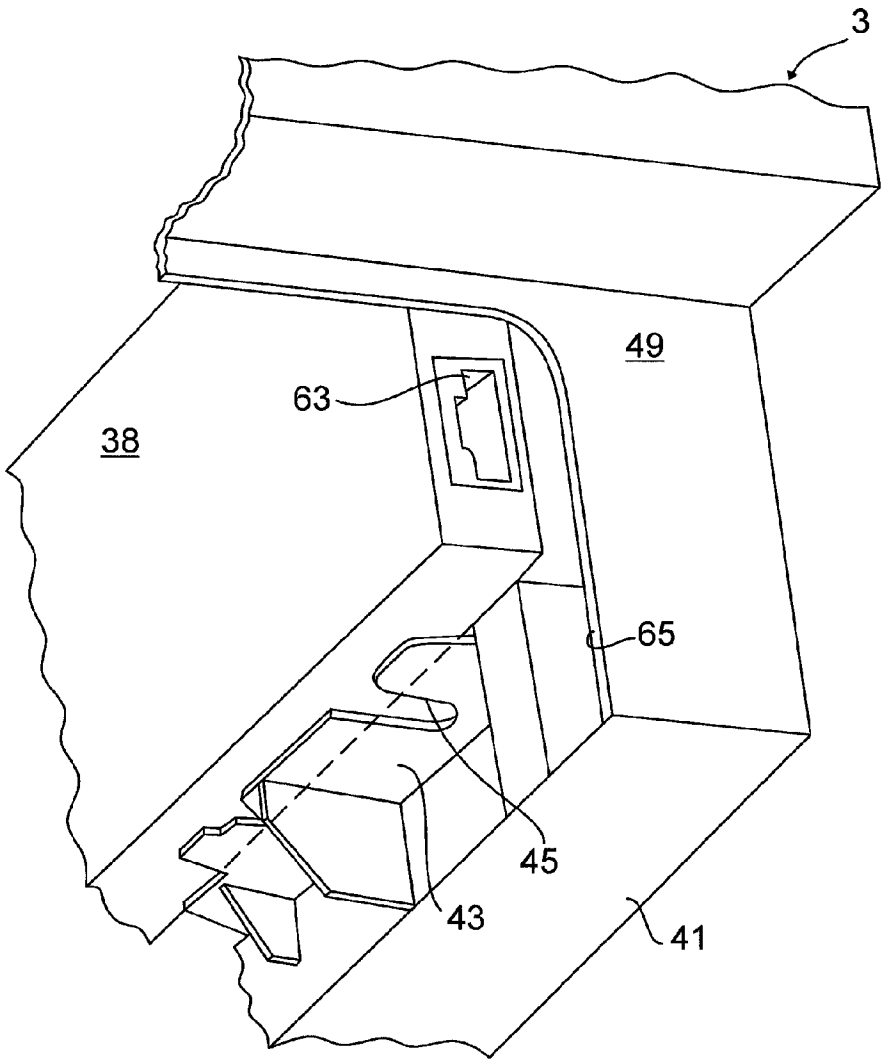
FIG. 6 shows a partial view of the rear of the electronic control module in its assembly position as well as with a connection for contact with a programming facility.

FIG. 6 shows an enlarged partial view of the wash compartment base wall 3 from the rear in its post assembly position as well as with an assembled electronic control module 38. The electronic control module 38 is supported on the support plate 43 with its lower peripheral face 61.

According to FIG. 6, the electronic control module 38 comprises a connection bush 63 on its rear side, said connection bush being exposed via an access opening 65 in the rear wall 49. The electronic control module 38 automatically connects with a programming device (not shown here) on the assembly line by way of the connection bush 63, so as to transfer control programs for the wash cycle of the dishwasher to the electronic control module 38.

What is claimed:

1. A dishwasher comprising:

a wash compartment with a base wall that has a retaining contour;

a supporting frame including a frame opening and a support plate; and an electronic control module configured to control appliance components in the dishwasher; wherein the retaining contour includes an elastically adjustable locking element embodied on the support plate that, in a locking, post-assembly position, engages and holds the electronic control module in the frame opening.

2. The dishwasher of claim 1, wherein the retaining contour forms an injected molded portion of the base wall of the wash compartment.

3. The dishwasher of claim 1, wherein the retaining contour is in an assembly space between the wash compartment and a freestanding surface of the dishwasher.

4. The dishwasher of claim 1, wherein the electronic control module is spaced a distance from a dishwasher base above a free height when in a post assembly position.

5. The dishwasher of claim 1, wherein the base wall protrudes beyond front and rear support profiles at its corner regions.

6. The dishwasher of claim 5, wherein the retaining contour is embodied at least partially on the support profiles and/or on the supporting frame.

7. The dishwasher of claim 6, wherein the retaining contour comprises a boundary wall of the frame opening.

8. The dishwasher of claim 7, wherein the retaining contour comprises a boundary wall at a lower face of the base wall.

9. The dishwasher of claim 5, wherein the electronic control module at least partially covers the frame opening and/or is arranged at least partially in the frame opening.

10. The dishwasher of claim 1, wherein the base wall protrudes beyond lateral supporting frames which bound the frame opening and which provides access for assembly and disassembly of the electronic control module.

11. The dishwasher of claim 1, wherein the retaining contour comprises a plurality of positioning stops which define the electronic control module in a depth direction and/or in a lateral direction.

12. The dishwasher of claim 11, wherein the position stops comprise a depth stop and/or a lateral stop.

13. The dishwasher of claim 11, wherein the positioning stops are at a distance from the support plate.

14. The dishwasher of claim 13, wherein the positioning steps are on a lower face of the base wall and/or on a rear wall protruding therefrom.

15. The dishwasher of claim 1, wherein the elastically adjustable locking element, in the post-assembly position, is located in front of the electronic control module in reference to an outward direction from the dishwasher.

16. A method for assembling a dishwasher that includes a wash compartment with a base wall that has positioning stops and a retaining contour, the retaining contour including an elastically adjustable locking element embodied on a support plate, a supporting frame including a frame opening and the support plate, and an electronic control module configured to control appliance components in the dishwasher, the method comprising:

inserting the electronic control module into the dishwasher between the positioning stops;

tilting the electronic control module towards the elastically adjustable locking element;

elastically adjusting the elastically adjustable locking element to permit the electronic control module to tilt into a final assembly position where the electronic control module is at least partially arranged in the frame opening and/or where the electronic control module at least partially covers the frame opening; and tilting the electronic control module into the final assembly position.

17. The method of claim 16, further comprising readjusting the elastically adjustable locking element to hold the electronic control module in the final assembly position.

* * * * *